US006474378B1

(12) United States Patent
Ryan et al.

(10) Patent No.: US 6,474,378 B1
(45) Date of Patent: Nov. 5, 2002

(54) PLUNGE ROUTER HAVING ELECTRONIC DEPTH ADJUSTMENT

(75) Inventors: William J. Ryan, Arlington Heights, IL (US); Carl C. Carlson, Vernon Hills, IL (US)

(73) Assignee: S-B Power Tool Company, Chicago, IL (US)

( * ) Notice: Subject to any disclaimer, the term of this patent is extended or adjusted under 35 U.S.C. 154(b) by 0 days.

(21) Appl. No.: 09/850,217

(22) Filed: May 7, 2001

(51) Int. Cl.[7] ..... B27C 1/00

(52) U.S. Cl. ..... 144/154.5; 144/136.95; 409/182; 409/187; 408/16

(58) Field of Search ..... 144/154.5, 382, 144/385, 136.95, 135.2, 134.1; 409/182, 181, 185, 186, 187; 408/10, 13, 16

(56) References Cited

U.S. PATENT DOCUMENTS

| | | | | | |
|---|---|---|---|---|---|
| 3,899,724 | A | | 8/1975 | Colton | |
| 4,319,860 | A | | 3/1982 | Beares | |
| 4,410,846 | A | * | 10/1983 | Gerber et al. | 318/490 |
| 4,513,381 | A | * | 4/1985 | Houser, Jr. et al. | 364/475 |
| 4,765,784 | A | | 8/1988 | Karwan | |
| 5,035,556 | A | | 7/1991 | Lamotte et al. | |
| 5,061,886 | A | * | 10/1991 | Yamada | 318/565 |
| 5,123,789 | A | * | 6/1992 | Ohtani et al. | 408/1 R |
| 5,207,253 | A | * | 5/1993 | Hoshino et al. | 144/136.95 |
| 5,320,463 | A | | 6/1994 | McCurry et al. | |
| 5,590,988 | A | * | 1/1997 | Rusconi | 144/136.95 |
| 5,592,793 | A | * | 1/1997 | Damratowski et al. | 144/135.2 |
| 5,671,789 | A | * | 9/1997 | Stolzer et al. | 144/136.95 |
| 5,725,036 | A | | 3/1998 | Walter | |

* cited by examiner

*Primary Examiner*—Allen Ostrager
*Assistant Examiner*—Shelley Self
(74) *Attorney, Agent, or Firm*—Greer, Burns & Crain, Ltd.

(57) ABSTRACT

A plunge-type router is disclosed which has a base and a head assembly that is vertically adjustable by an adjusting mechanism. The plunge router includes an electronic control system with a digital display and control functionality that enables the router to accurately determine a baseline or zero position for a router bit installed in the router and permits the user to input a depth of cut value or other predetermined command. The control system then automatically causes the motorized adjusting mechanism to go to the appropriate position. The electronic control system enables the storage of multiple depth settings as well as multiple step or macro operations. In this regard, macros may be run to provide incremental cutting necessary for performing multiple passes to achieve a relatively deep depth of cut.

22 Claims, 9 Drawing Sheets

PLUNGE ROUTER HAVING ELECTRONIC DEPTH ADJUSTMENT

The present invention generally relates to power hand tools and, more particularly, to plunge-type routers.

BACKGROUND OF THE INVENTION

Plunge-type routers are used to cut a variety of shapes in work pieces made of wood and other materials, with the shapes being determined by the kind and shape of router bits used, the depth of cut of the bit and the path of travel by the router bit relative to the work piece. A plunge router is constructed to move the router bit toward and away from the work piece when the router is being operated by hand. The depth of cut of the router bit is typically determined by an adjustable depth stop system which may or may not include means for locking the router in its plunged position.

During operation, the plunge router may be supported on the work piece with the bit retracted and placed in the desired position so that when it is turned on and plunged, the router bit advances into the work piece where the operator moves it relative to the work piece to complete the desired routing operation. To do the plunging operation, the operator must exert a downward force on the head assembly, generally by pressing on handles attached to it, to move the router bit into contact with the work piece. The head assembly is typically biased to automatically retract the router bit from the work piece when the downward force imparted by the operator is removed.

Plunge routers generally include a plunge adjustment mechanism that enables the operator to control the distance the router bit can move toward the work piece and thereby determine its depth of cut. As is well known to those who have used plunge type routers, the adjustment of the stop system must be carefully done to achieve the desired depth of cut. Because the type and size of various router bits are very different, it is prudent if not absolutely necessary to recalibrate or reset the adjustment means after any manipulation of the router bit to insure that it has been accurately set to achieve the desired depth of cut. There are many other devices that attempt to accurately set the depth adjustable stop to provide an accurate depth of cut including adjustable rods, scales with indicators, micrometer type adjusters and other systems. Such adjustable stop mechanisms in the prior art are generally hand manipulated and some may have a printed scale or other indicia located on the mechanism for use in providing a specified depth of cut. However, it is still necessary for users to carefully measure the depth of cut in one way or another to insure that the desired cut will be made. In this regard, it is often common practice to perform a test cut on a scrap piece and actually measure the result and to iteratively adjust the stop mechanism until the proper result is achieved.

SUMMARY OF THE INVENTION

A plunge-type router is disclosed which is adapted for either free hand use or mounted beneath a router table. The router has a base and a head assembly with the base being adjustable relative to the head assembly by an adjusting mechanism. The plunge router of the present invention includes an electronic control system with a digital display and control functionality that enables the router to accurately determine a baseline or zero position for a router bit installed in the router and permits the user to input a depth of cut value or other predetermined command. The system then automatically adjusts a motorized depth adjustment mechanism to achieve the appropriate position. The electronic control system enables the storage of multiple depth settings as well as multiple step or macro operations. In this regard, macros may be run to provide incremental cutting necessary for performing multiple passes to achieve a relatively deep depth of cut.

The present invention may include as an alternative embodiment a supplemental electronic control panel that can enable a user to install the plunger router in a router table and yet have a control panel clearly visible to the user even though the router is mounted underneath the table surface in an inverted position. The electronic system also enables the choice of either metric or English units of measure. The speed of operation of the main drive motor can be provided on the display, as well as an identification of a macro number or other information relating to the particular operation that is being carried out. In the event of multiple step macro operation, stepping between progressively deeper depths of cut may be manually triggered by the user on the control panel and displayed thereon.

DETAILED DESCRIPTION

Figure 10:
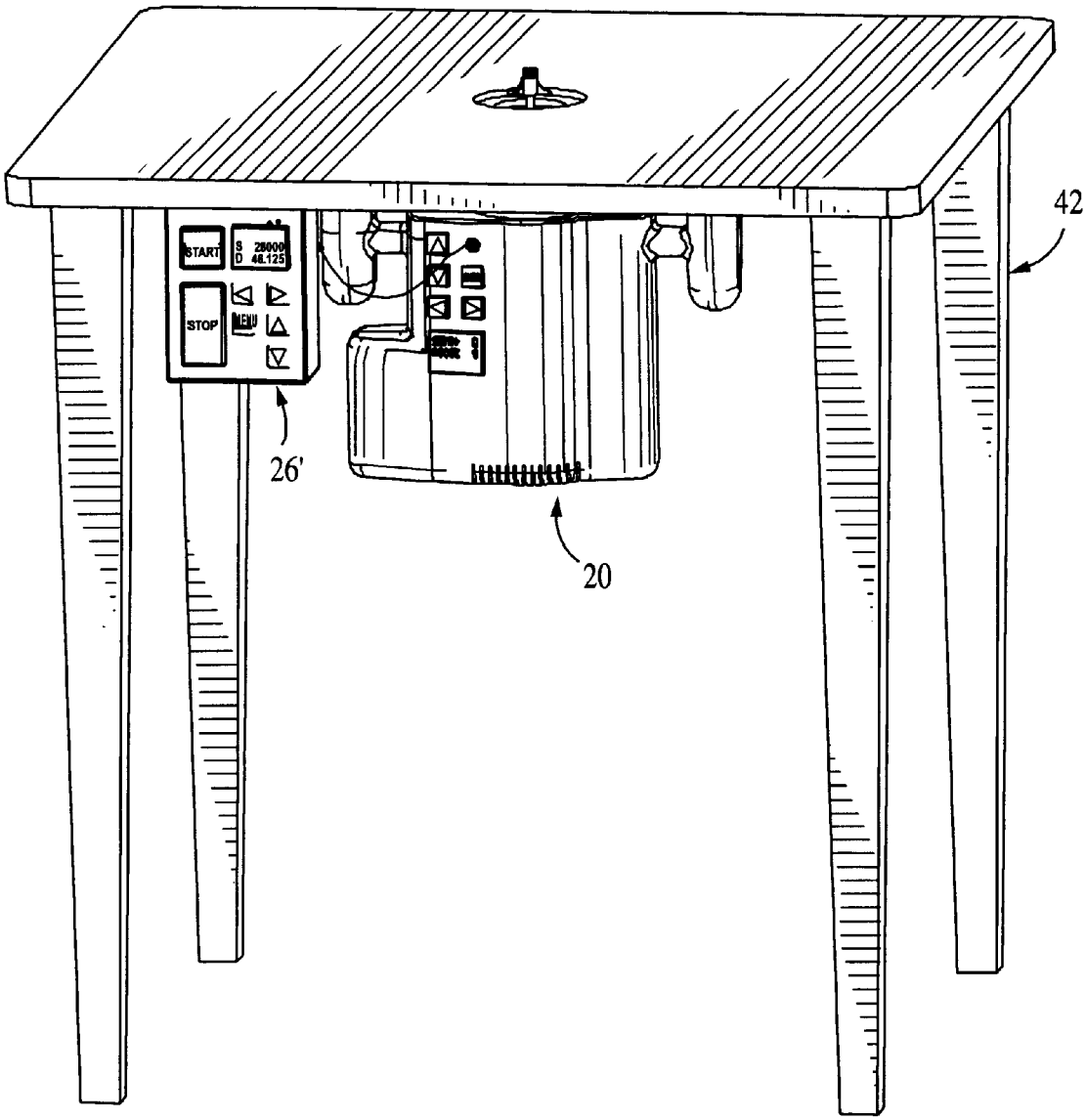

A preferred embodiment of the present invention is shown in FIGS. 1–5 and indicated generally at 20. The router 20 has a motor housing assembly 22 that includes a pair of handles 24 preferably integrally formed with the housing assembly. A control panel, indicated generally at 26, is preferably installed in the motor housing assembly 22 and includes a visual display 28 that is preferably an LCD display, but may be other known types of electronic display such as an LED display, for example. The control panel 26 also includes pushbuttons 30 and 32 which are adapted to raise and lower the router bit relative to a work piece, a menu pushbutton 34 and pushbuttons 36 and 38 which may be used to either change the menu selections or trigger changes in the operation of the router in a manner that will be hereinafter described. A socket 40 is provided for connecting an auxiliary control panel 26' for use when the router 20 is attached to a router table 42, as shown in FIG. 10.

The motor housing assembly 22 is connected to a base 44 by a depth adjusting assembly, indicated generally at 46, which includes a pair of plunge posts 48 and 50 that are slidable in cylindrical channels 52 and 54 that are part of the motor housing assembly 22. A protective cylindrical accordion bellows structure 56 and 58 are provided to protect the interface between the posts and their respective channels and keep the posts from eventually binding up due to wood or other material shavings and dust produced by operation of the router. The motor housing assembly 22 has a conical lower portion 60 with a central opening through which the output shaft 62 of a motor 64 passes. A collet chuck 66 or the like is used to secure a router bit 68 and the router bit 68 and collet chuck 66 extend through an aperture 70 located in the base 44 to adjust the depth of cut, i.e., the position of the bit 68 relative to the bottom surface 72 of the base 44. The main drive motor is turned on and off by a switch 74 located in the right handle 24.

Figure 1:
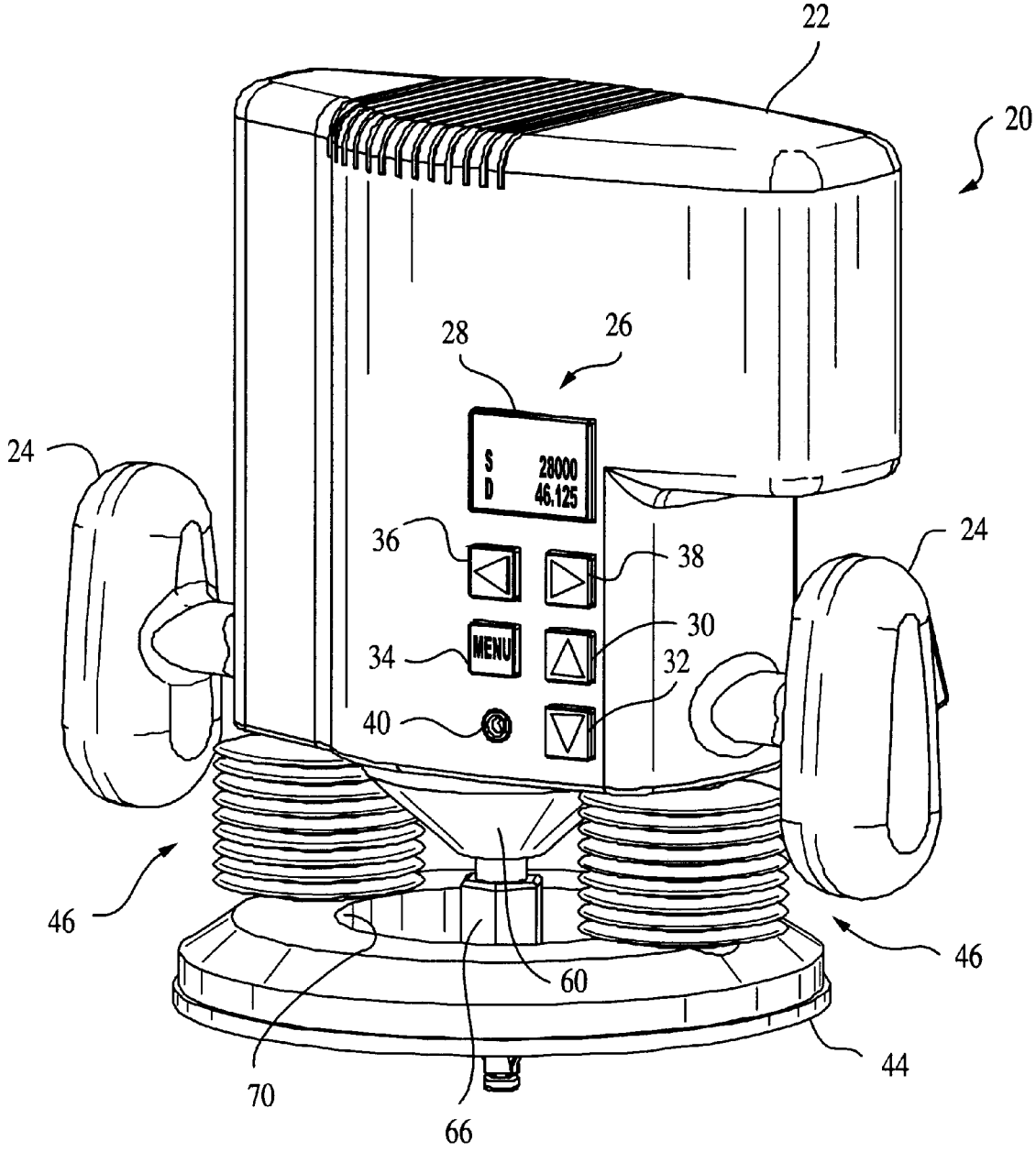
FIG. 1 is a perspective view a preferred embodiment of the plunge router of the present invention.
Figure 3:
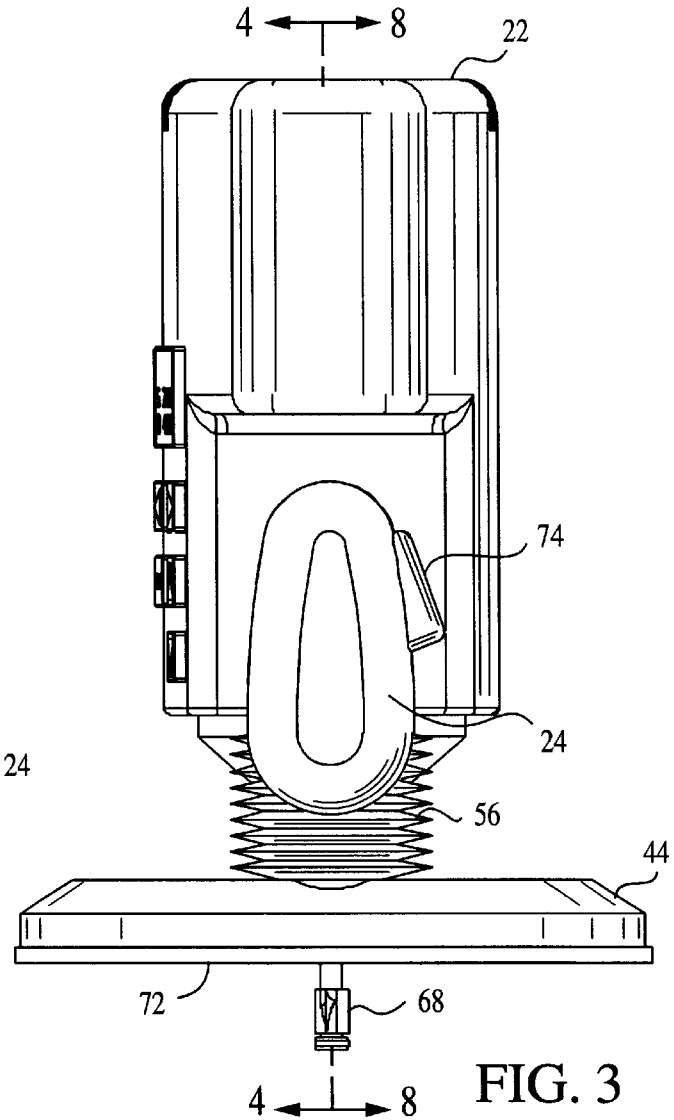
FIG. 3 is a right side view of the plunge router shown in FIG. 1.
Figure 2:
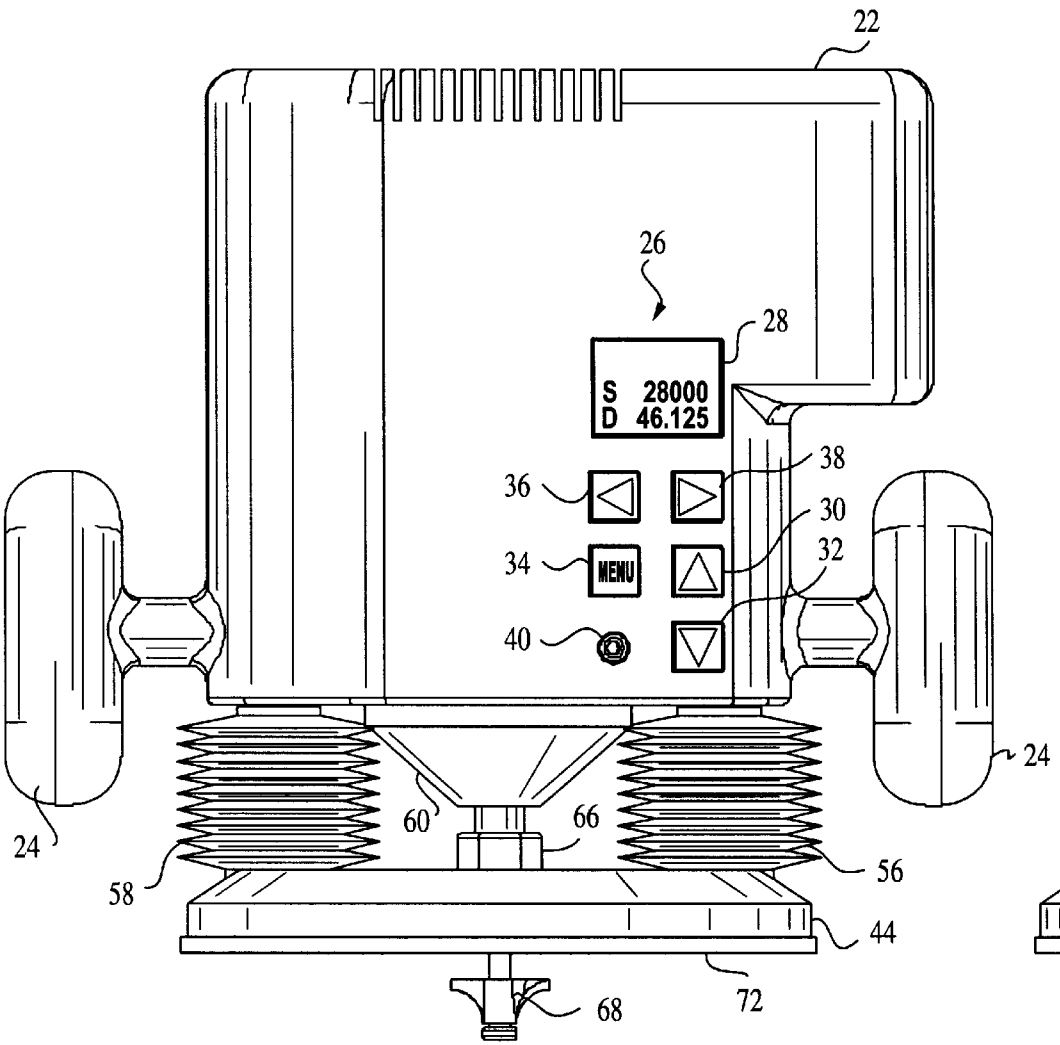
FIG. 2 is a front view of the plunge router shown in FIG. 1.
Figure 4:
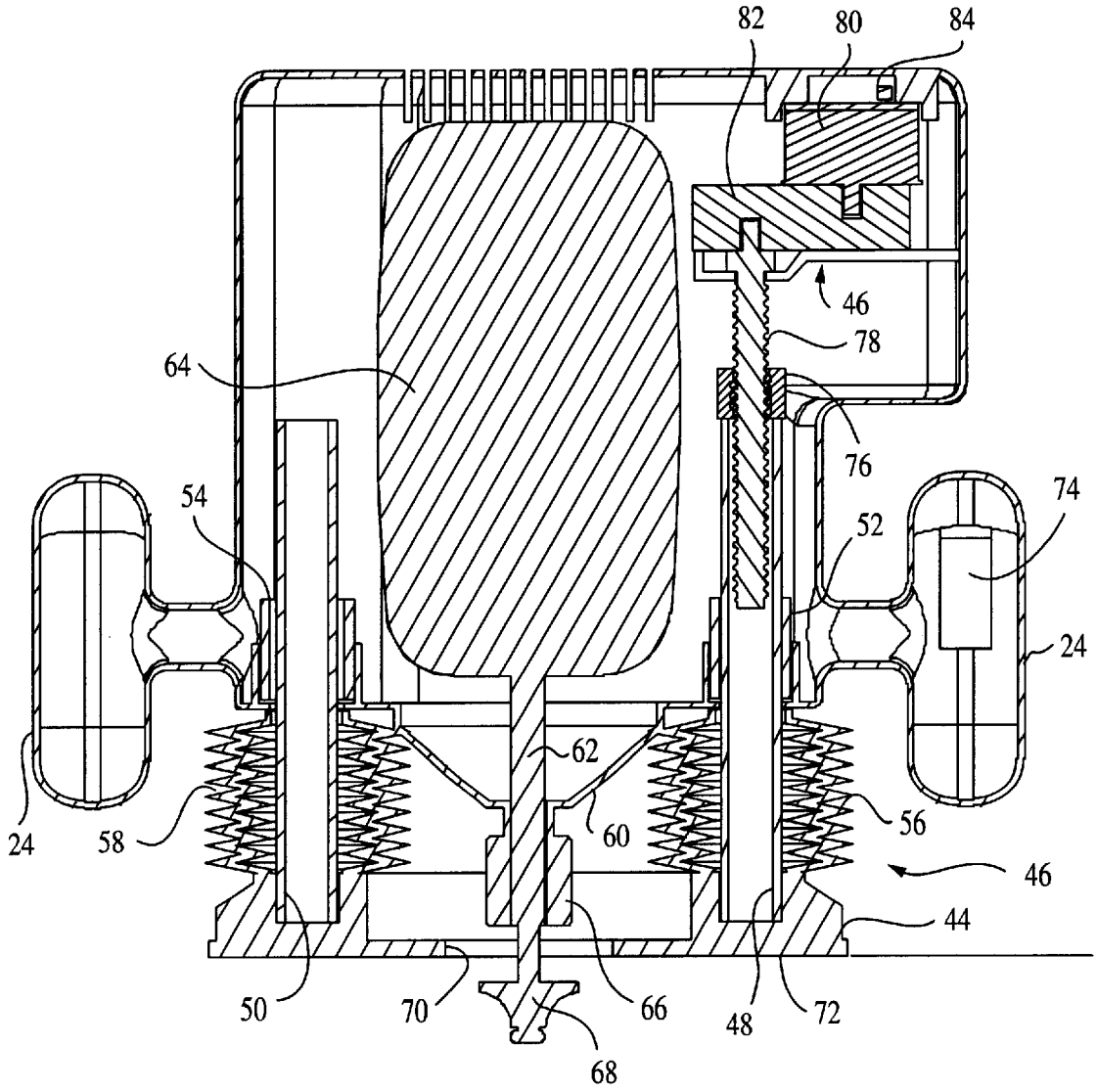
FIG. 4 is a cross section taken generally along the line 4—4 of FIG. 3.
Figure 5:
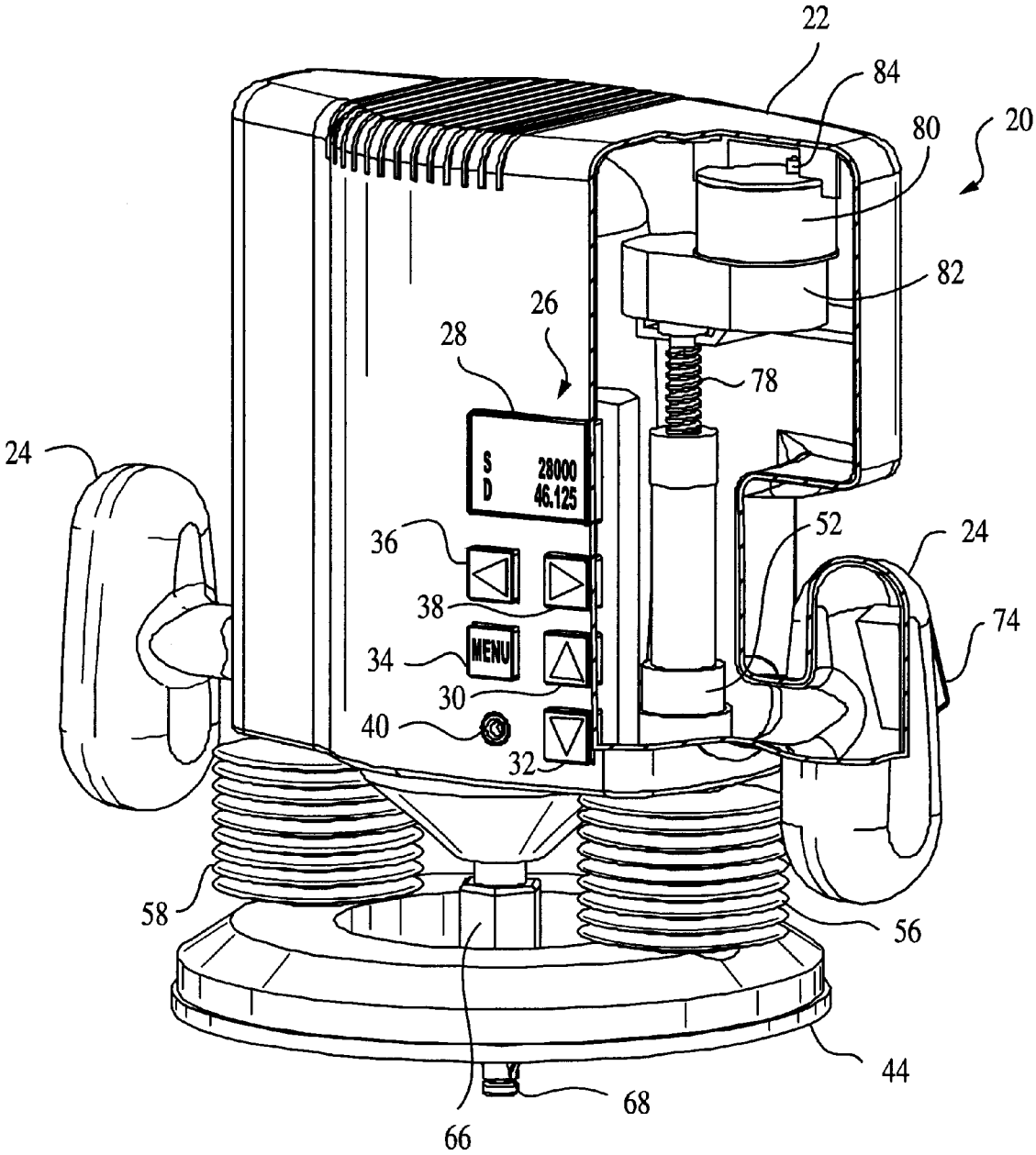
FIG. 5 is a perspective view similar to FIG. 1, but shown with portions removed.

To adjust the depth of cut, the base is adjusted relative to the housing assembly 22 and therefore the router bit 68. This is accomplished by a depth adjusting mechanism 46 having one of the posts, such as post 48 as shown in FIGS. 4 and 5, with an attached threaded nut 76, with the nut engaging a threaded rod 78 that is driven by a motor 80 through a gear mechanism 82. The motor 80 is preferably a servo motor, but may be a stepper or other suitable motor. During operation, activation of the motor 80 causes its output shaft to drive the gear mechanism 82 and rotate the rod 78 which will then cause the captive nut and post 76 to move upwardly or downwardly relative to the rod and housing assembly 22 depending upon the direction of rotation of the rod 78. This movement also necessarily adjusts the position of the bit 68 relative to the bottom surface 72 of the base 44. A tachometer, resolver, encoder or other sensing mechanism 84 is operably connected to the motor 80 to detect rotation of the motor output shaft. Since the pitch of the threads of the rod 78 is known or can be determined, as can the mechanical advantage of drive mechanism 82, the angular movement of the motor 80 output shaft directly translates into vertical movement of the housing assembly relative to the base and enables the elevation of the router bit to be accurately determined relative to the position of the bottom surface 72 of the base.

Figure 6:
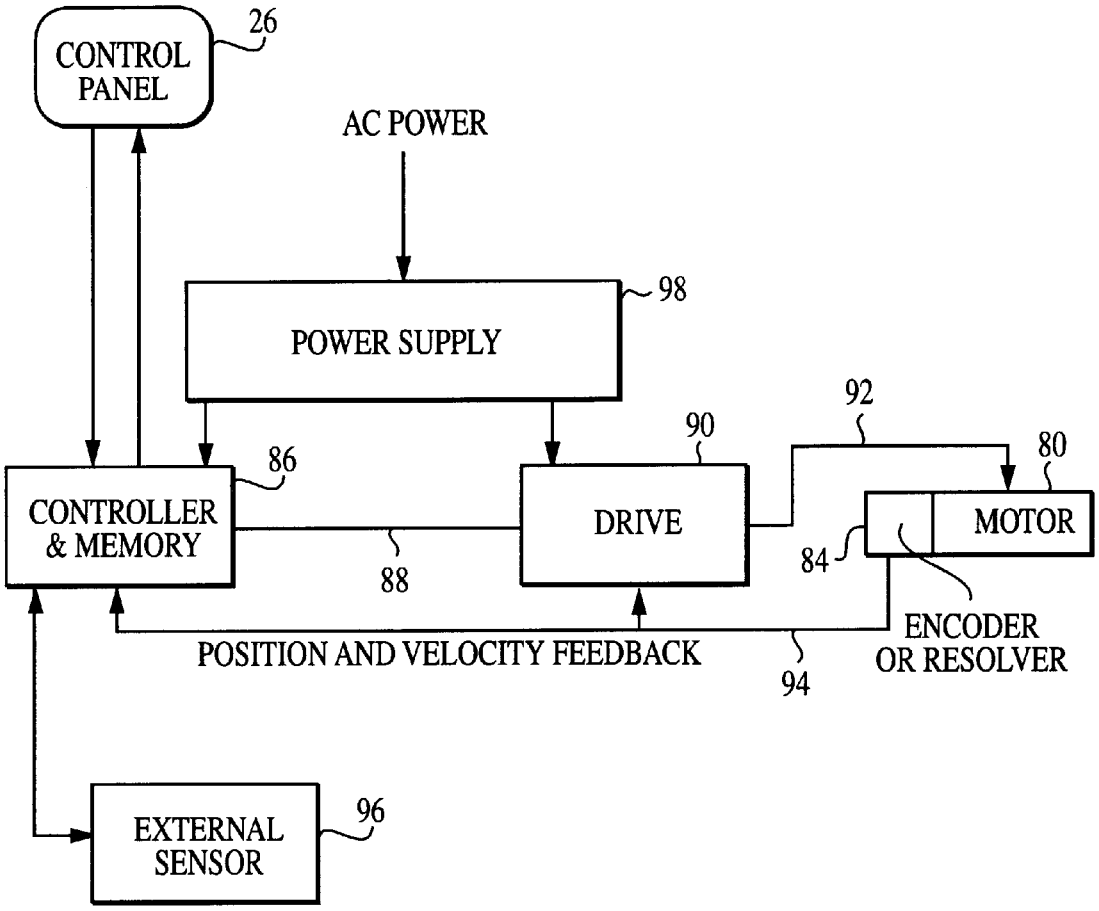
FIG. 6 is a block diagram of the electronic system that controls the depth adjusting mechanism.

In accordance with an important aspect of the present invention and referring to the electrical block diagram of the plunger outer depth adjustment control system shown in FIG. 6, the control panel 26 is connected to a controller 86 which preferably includes a nonvolatile memory for storing data relating to the operation of the system. The controller 86 is adapted to provide output signals on line 88 which are applied to drive circuitry 90 of conventional design depending upon the type of motor that is being driven, with the drive output being applied on line 92 to the adjustment motor 80. The tachometer 84 is operatively connected to the motor 80 and provides signals on line 94 that provide feedback information to one or both of the controller 86 or the drive circuitry 90 depending upon the particular implementation that is used.

An external sensor 96 is connected to the controller 86 and provides information for zeroing the router hit 68. In this regard, zeroing is intended to mean that the very bottom of the router bit 68 is at the same elevation as the bottom surface 72 of the base 44. A power supply 98 provides proper voltages to the controller 86 and drive circuitry 90. The controller 86 and memory may be a microprocessor, a digital signal processor and ASIC integrated circuit, as well as many other types of programmable logic devices. The external sensor 96 is preferably one that either "feels" or "sees" the relative position of the work piece and router bit 68. In this regard, it is contemplated that such external sensors may be a camera or CCD sensor, a laser device, a sensitive pad device or sensing fingers. In the preferred embodiment, the external sensor 96 is a load sensing device adapted to monitor the load on the motor 80 as the outer bit 68 is moved downwardly into contact with the surface of the work piece. If the work piece is flat, then the surface 72 would be in close contact with the work piece and movement of the router bit downwardly into contact with the work piece would provide an accurate zero position for the router.

At that moment, it is contemplated that the menu button 34 can be pushed to reveal a reset or zero option which could be entered by pushing an appropriate one of the buttons 36 and 38 depending upon the manner of implementation that is carried out. Once the zero position is entered, then the user can use the menu pushbutton to enable the depth of cut to be entered by using button 32 to increase the depth of cut or alternatively 30 to decrease it. It is also preferred that the pushbuttons 30 and 32, when held down will result in continuous operation of the motor 80 to either increase or decrease the depth of cut. It is preferred that the depth of cut be displayed on the display 28 during such adjustment. It may also be programmed so that a mere quick depression and release of either of the pushbuttons would result in a definite amount of incremental movement of the bit in the appropriate direction. In this regard, it is contemplated that the elevation of the bit may be changed in $1/10{,}000$ th inch intervals in this manner. Alternatively, the menu may be sequenced through predetermined incremental depths such as tenths of an inch or quarters of an inch, for example. If the total depth of cut is ½ inch, for example, the controller may be programmed to operate as a macro which would perform a ½ inch cut in two ¼ inch increments. The menu pushbutton 34 may also have a menu item which enables the router to be converted between American and metric units. It is also contemplated that the control panel 26 include a numeric keyboard so that a user could merely key in the depth of cut that is desired and the system will go there upon activation.

It should also be understood that the tachometer 84 may be an optical encoder, resolver or other type of device that is adapted to provide rotary position information relating to the operation of the motor 80.

Figure 7:
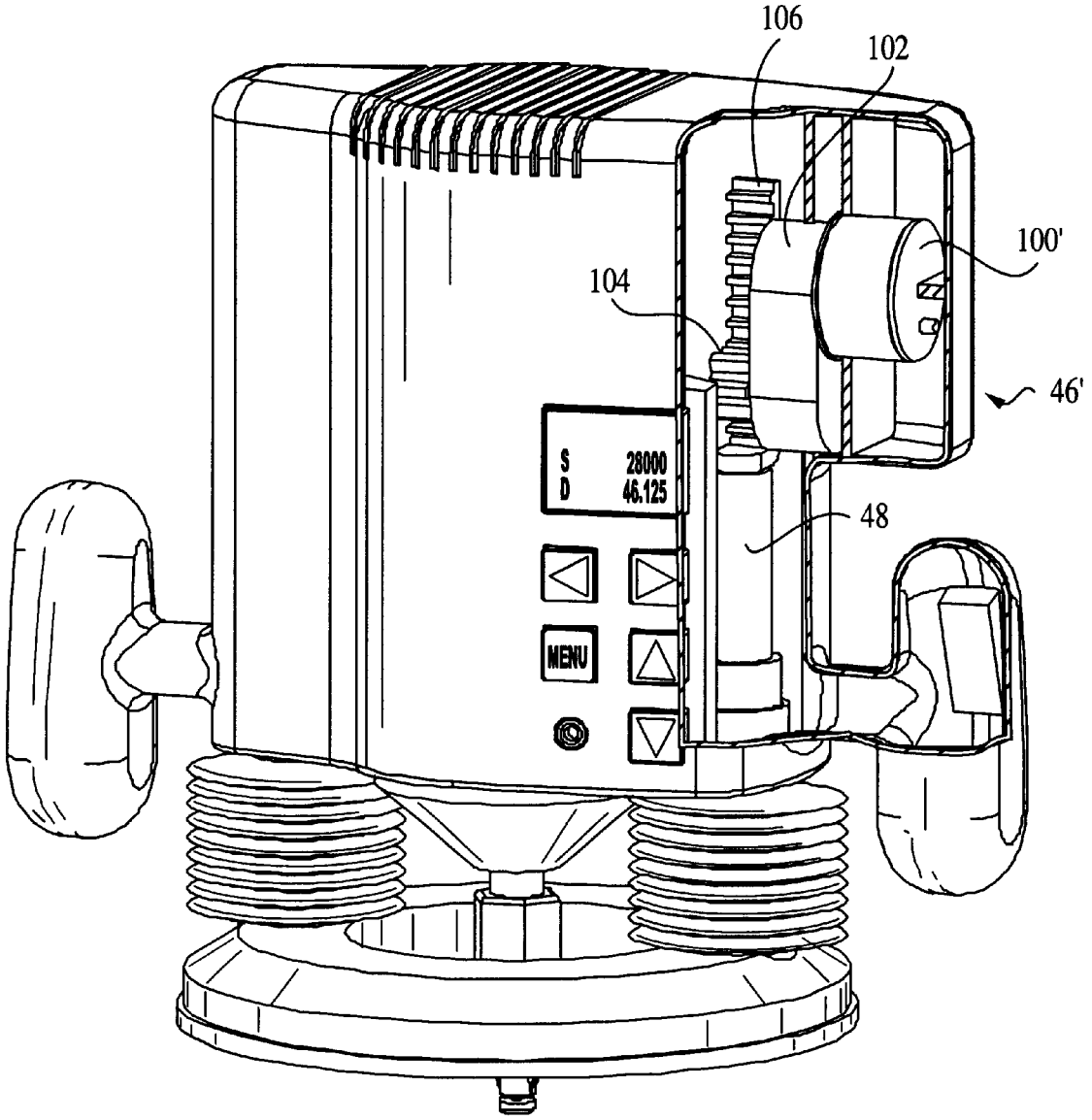
FIG. 7 is a perspective view shown with portions removed of an alternative embodiment of the plunge router embodying the present invention.
Figure 8:
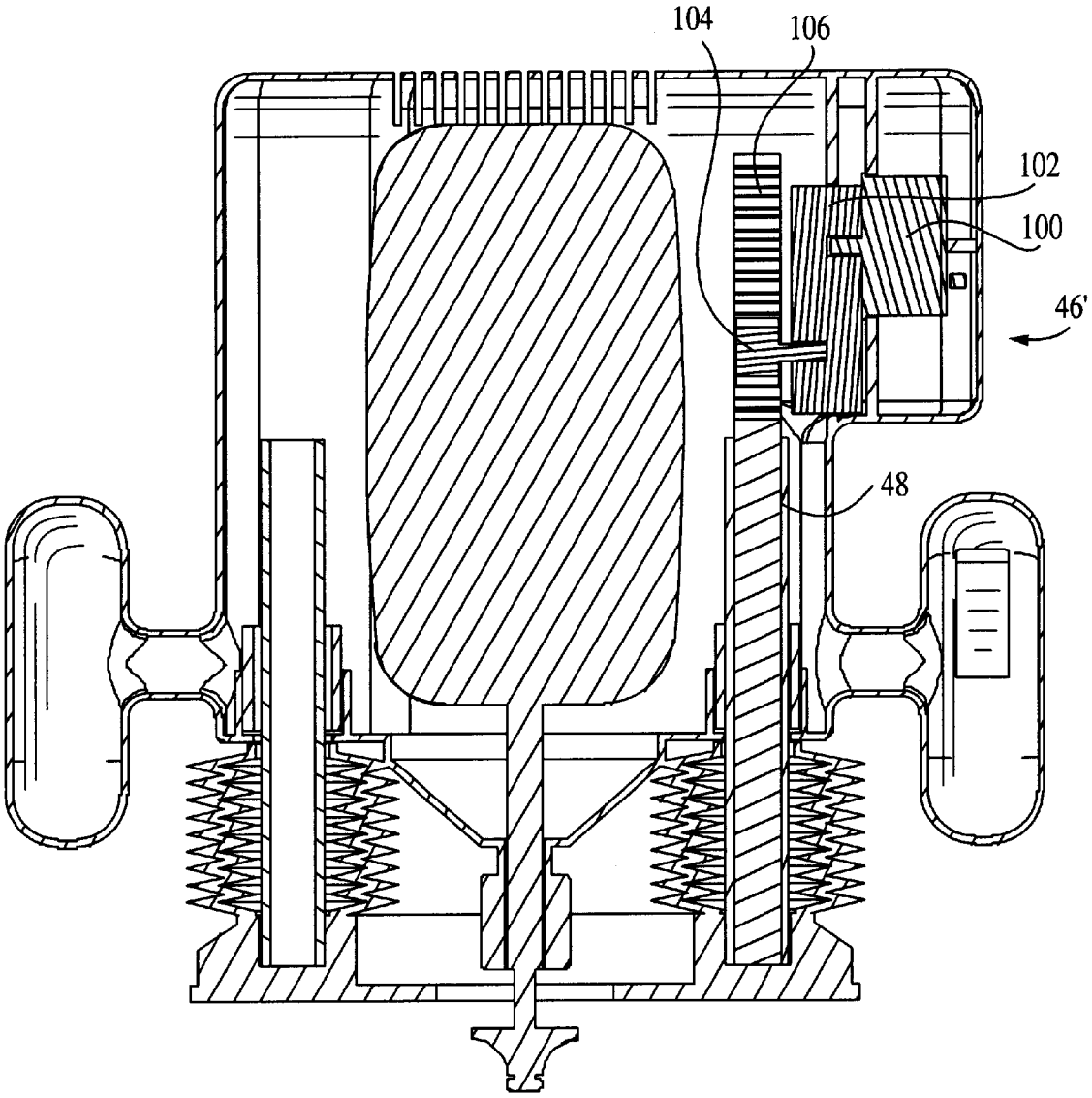
FIG. 8 is a cross section of the embodiment shown in FIG. 7.

In accordance with another aspect of the present invention, a first alternative embodiment is shown in FIGS. 7 and 8 wherein instead of a depth adjusting mechanism 46, a depth adjusting mechanism 46' is illustrated. Rather than having a fixed nut and a threaded rod 78 driven by the motor 80 and drive mechanism 82, a motor 100 is positioned to drive a gear mechanism 102 that has an output connected to a pinion gear 104 that engages the teeth of an elongated rack 106 which is attached to the post 48. This embodiment is otherwise substantially similar to the embodiment shown in FIGS. 1–5.

Figure 9:
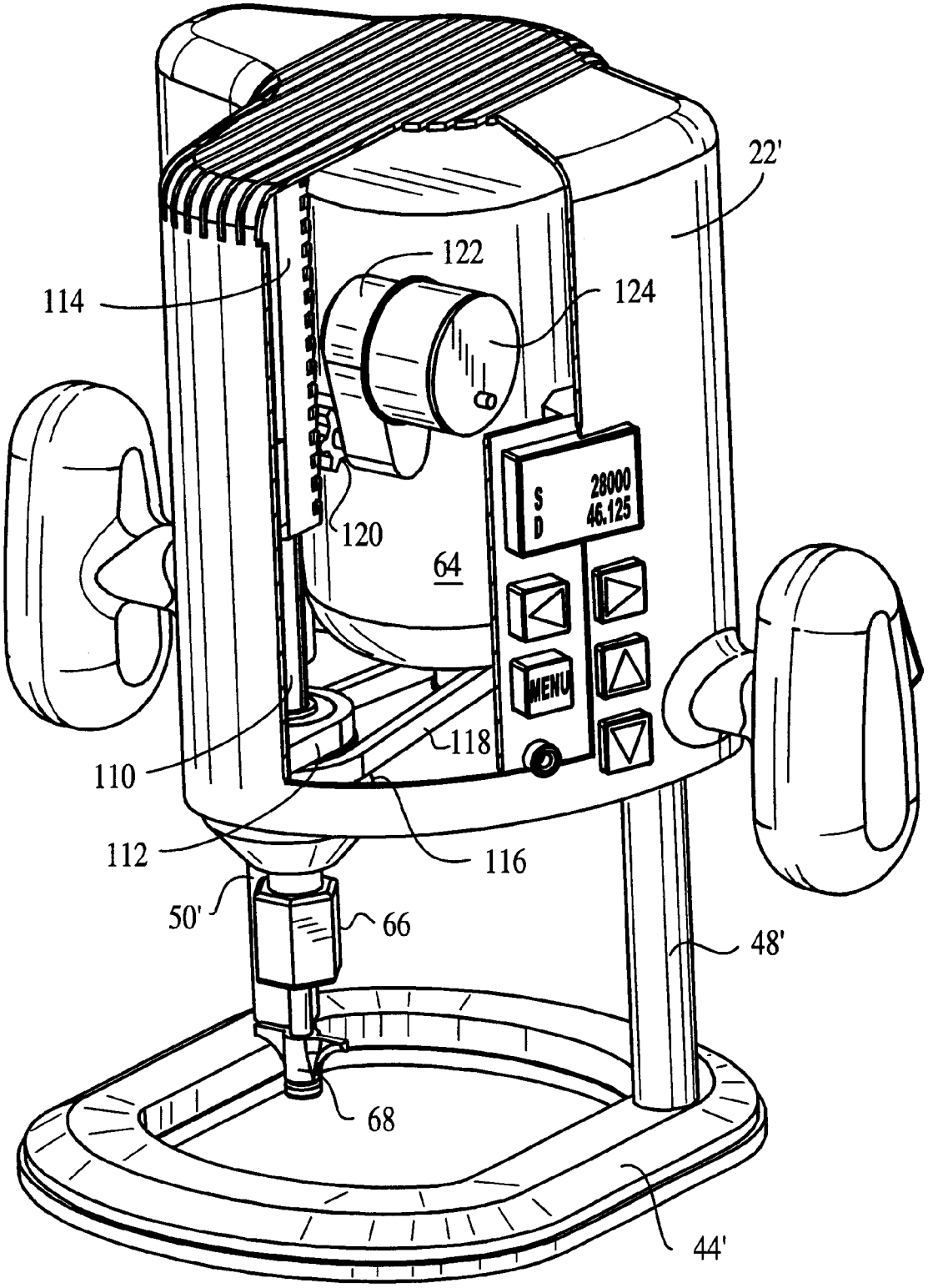
FIG. 9 is a perspective view of a second alternative embodiment shown with portions removed and particularly illustrating an offset spindle; and, FIG. 10 is a perspective view of a plunge router mounted to a router table and illustrating an auxiliary control panel.

In accordance with another aspect of the present invention, a second alternative embodiment is shown in FIG. 9 and includes a housing assembly 22' that has a different shape than that shown in the preferred embodiment and the first alternative embodiment. An important difference is that the collet chuck 66 is attached to a splined shaft 110 which is rotatable in a bracket 112 and also in a rack member 114. A pulley 116 is provided and is attached to the splined shaft 110 with the pulley 116 being driven by a belt 118 that is driven by another pulley located on the output shaft of the motor 64. The rack 114 can be vertically moved by the pinion gear 120 that is driven by gear mechanism 122 and drive motor 124. Thus, when the rack is vertically moved, it vertically moves the shaft 112 as well as the collet chuck 66 and router bit 68 in a vertical direction. Because of the described movement, it should be apparent that the posts 48' and 50' do not move relative to the housing assembly 22' and the base 44' is somewhat larger, including a larger opening in which to observe the work piece during operation. The offset spindle construction enables a user to see the drill bit perhaps better than the other embodiments that have been shown and described.

From the foregoing, it should be understood that various embodiments of a plunge router have been shown and described which offer many desirable attributes compared to the prior art. The sophistication of the design provides accurate depth of the cut and adjustment in addition to flexibility its functionality and operation that has not heretofore been achieved. The functionality of the control panel is convenient and straightforward and an auxiliary control panel can be plugged into the router so that a control panel is visible to the user even when the router is mounted in an inverted position beneath a router table.

While various embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the following claims.

What is claimed is:

1. A router adapted to drive a router bit and control the depth of cut of the router bit relative to a work piece, said router comprising:

a housing assembly having a drive motor and at least a pair of operating handles, the drive motor being adapted to drive a drive shaft to which the router bit is attached during operation;

a base having a generally planar outer surface and a central opening through which the router bit can extend, and at least a pair of posts that are operatively connected to said housing assembly;

a depth adjusting assembly for controlling the depth of cut of a router bit relative to the baseline position, said depth adjusting assembly including a control motor being adapted to move the router bit in the axial direction to vary the depth of cut responsive to electrical control signals being applied thereto;

means for generating position signals indicative of the axial position of the router bit;

input means responsive to operator manipulation for generating input signals for controlling the operation of the router;

processing means adapted to receive said position and input signals and generate control signals for selectively operating said control motor to control said depth adjusting assembly and for controlling the speed of operation of the drive motor and to generate information signals relating to the operation of the router, said processing means including memory means for selectively storing control and information data relating to the operation of the router; and, display means operatively connected to said processing means and adapted to selectively provide a visual display of information relating to the operation of the router.

2. A router as defined in claim 1 wherein said processing means is adapted to store data defining a baseline position for the router bit responsive to operator manipulation of said input means, said baseline position including the position of the router bit when it initially engages the work piece when the router is being used free hand or mounted beneath a router table.

3. A router as defined in claim 2 wherein said processing means is adapted to receive said position signals and said input signals and generate control signals for controlling the depth of cut of the router bit relative to said baseline position.

4. A router as defined in claim 3 wherein said display means is adapted to receive information signals from said processing means and visibly display the depth of cut in English or metric increments.

5. A router as defined in claim 4 wherein said input means is adapted to generate input signals for incrementing or decrementing the depth of cut responsive to operator manipulation thereof.

6. A router as defined in claim 5 wherein said input means comprises switch means adapted to selectively increment or decrement the depth of cut responsive to operator manipulation thereof, said input means further comprising switch means for controlling the power to the router and for controlling the speed of operation of said drive motor.

7. A router as defined in claim 6 wherein said display means is adapted to visibly display the operating speed of one of said drive motor or said router bit.

8. A router as defined in claim 1 wherein said processing means is adapted to control said depth adjusting assembly to control the maximum depth of cut during a cutting procedure, said processing means being adapted to perform a cutting operation in at least two steps of less than maximum depth during a cutting operation when the maximum depth of cut exceeds a predetermined amount.

9. A router as defined in claim 1 wherein said processing means is adapted to control said depth adjusting assembly to vary the depth of cut during a cutting procedure.

10. A router as defined in claim 1 wherein data relating to at least one particular depth of cut can be stored in said memory means of said processing means.

11. A router as defined in claim 1 wherein said housing assembly includes a pair of channels in which said pair of posts is movably positioned, said drive motor and drive shaft being mounted at a stationary location in said housing assembly, the movement of said base relative to said housing means varying the position of said router bit relative to said planar outer surface.

12. A router as defined in claim 11 wherein said control motor is located within said housing assembly and is operably connected to a pinion gear that engages a rack surface located within one of said posts, the rotation of said pinion gear in first and second directions causing said base to move relative to said housing means in first and second directions.

13. A router as defined in claim 11 wherein said control motor is located within said housing assembly and is operably connected to an elongated screw located within one of said posts that engages a stationary nut attached to said one post, the rotation of said screw in first and second directions causing said base to move relative to said housing means in first and second directions.

14. A router as defined in claim 1 wherein said housing assembly and said base are integrally coupled together, said depth adjusting assembly including a gear mechanism coupling said drive motor and said drive shaft, said gear mechanism offsetting the axis of said motor relative to the axis of said drive shaft, said drive shaft being movable in its axial direction, said control motor being connected to said drive shaft so that movement of said drive shaft varies the position of said router bit relative to said planar outer surface.

15. A router as defined in claim 1 wherein said display means comprises a visual display adapted to illustrate alphanumeric characters.

16. A router as defined in claim 15 wherein said visual display is a liquid crystal display.

17. A router as defined in claim 1 including a remote display means that is adapted to be connected to said processing means, said remote display means being adapted to visibly display said information relating to the operation of the router.

18. A router as defined in claim 1 wherein said control motor is a stepper motor.

19. A router as defined in claim 1 wherein said control motor is a servo motor.

20. A router as defined in claim 2 wherein said position signal generating means comprises means for sensing the position of a work piece relative to said housing assembly.

21. A router as defined in claim 20 wherein said position signal generating means comprises means for sensing the increase in electrical load of said control motor when operating the same to move the router bit into contact with the work piece.

22. A router as defined in claim 21 wherein said position signal generating means comprises means for detecting the surface of the work piece.

* * * * *